United States Patent [19]

Hendriks et al.

[11] 4,048,538

[45] Sept. 13, 1977

[54] GAS DISCHARGE CHARACTER DISPLAY TUBE WITH APERTURED MICA PLATE

[76] Inventors: Adrianus A. M. Hendriks; Henri-Jean G. M. Van Daelen, both of Emmasingel, Eindhoven, Netherlands

[21] Appl. No.: 696,230

[22] Filed: June 15, 1976

[51] Int. Cl.[2] ..... H01J 61/067; H01J 61/36; H01J 61/64

[52] U.S. Cl. ..... 313/519; 313/174; 313/217; 313/220

[58] Field of Search ..... 313/519, 217, 517, 518, 313/220, 174

[56] References Cited

U.S. PATENT DOCUMENTS

| | | | |
|---|---|---|---|
| 2,783,408 | 2/1957 | Williams et al. | 313/517 |
| 3,641,383 | 2/1972 | Tagawa | 313/519 |
| 3,735,181 | 5/1973 | Kobayakawa et al. | 313/217 X |
| 3,811,060 | 5/1974 | Tsujimoto | 313/217 X |
| 3,842,313 | 10/1974 | Daelen et al. | 313/519 X |

*Primary Examiner*—Palmer C. Demeo

*Attorney, Agent, or Firm*—Frank R. Trifari; Carl P. Steinhauser

[57] ABSTRACT

In a two-digit glass indicator tube the cathode segments with their supply conductors are fixed by enamel to the flat rear walls below a frame of sintered glass against which the front wall bears. Bent parts of conductors and electrodes determine the distance between the front wall and the rear wall. Other parts clamp a mica plate on the supply conductors.

3 Claims, 5 Drawing Figures

GAS DISCHARGE CHARACTER DISPLAY TUBE WITH APERTURED MICA PLATE

The invention relates to a gas discharge tube for displaying at least two characters by means of cathode glow-discharge light in adjacent matrix groups, the matrix elements in at least one group consisting of elongate cathode strips which are arranged around two plate-shaped anodes as a stylized 8, both the cathode strips and the anodes each forming one assembly with their supply conductors which are secured in a vacuum-tight manner to the glass rear wall by means of enamel. The invention furthermore relates to a method of manufacturing such a tube.

Tubes as described above in a digit size of 1 to 2 cm are suitable for use in clocks, cash registers, digital measuring instruments, TV-channel indicators, and the like. In all these applications there are three important requirements, namely clear display, long lifetime and low price. The display is determined by the design, for example the ratio length-width of the cathode strips, colour influence of the gas mixture and possible sputtering on the glass wall. The lifetime depends on the electrode material and the gas filling. The price of said tubes is determined only to a smaller extent by the raw materials and to a larger extent by processing costs in machines and furnaces, as well as by assembly work and checks, especially when the assembly is carried out manually for the greater part.

It is the object of the invention to provide a construction which, as regards the processes, can lead to savings, and which tube can also be evacuated easily.

According to the invention, in a gas discharge tube for displaying at least two characters of the above mentioned kind, the front and rear walls both consist of flat glass and are connected together by means of a frame of sintered glass. A mica plate in the tube which does not cover the active front sides of the electrodes is clamped between bent parts of the supply conductors and parts of strips fixed by means of enamel with the current conductors to the rear wall. The distance between the front wall and the rear wall is determined by parts of said strips bent at right angles to the rear wall. The conductive parts are fixed by enamel to the rear wall only below the frame of sintered glass and the anodes being moreover fixed by enamel to the rear wall over a part of their surface.

As is usual in this technique, the cathode strips are etched or punched in coherent groups in strips. The flat glass is considerably cheaper than the frequently used dish-shaped front and/or rear walls and also the frame consisting of sintered glass is low in price. Due to the small mass, according to the invention the strips need be fixed by enamel to the rear wall only below the frame of sintered glass. Only the anodes are secured over a part of their surface by means of enamel. The electrodes will become positioned higher than the rear wall so that no short-circuits by sputtered layers can occur. The mica plate which is clamped by the bent parts of the strips can be provided on the electrodes by machine, which results in considerable savings. The tube cannot only be constructed with two identical matrix groups but can also be constructed as a 1½ digit tube, a digit being displayed in one group and only the digit 1 and also the + and − signs, or a similar combination, being displayed in the other group.

According to the invention the mercury pill which is also a getter, can be clamped by bent parts of the strips projecting through the mica, the mercury pill being positioned between the two matrix groups. According to the invention, an intermediate voltage may be applied to the pill.

It is particularly favourable if according to the invention the exhaust tube is incorporated in the frame of sintered glass. In that case no hole need be made in the rear wall. Upon pumping and firing in a furnace the tubes can be stacked in contrast with the known tubes in which the exhaust tube extends at right angles to the front or rear wall.

The invention will now be described in greater detail with reference to the drawing, in which FIG. 1 shows the rear wall with enamel provided thereon, FIG. 2 is a cross-sectional view thereof;

Figure 1:
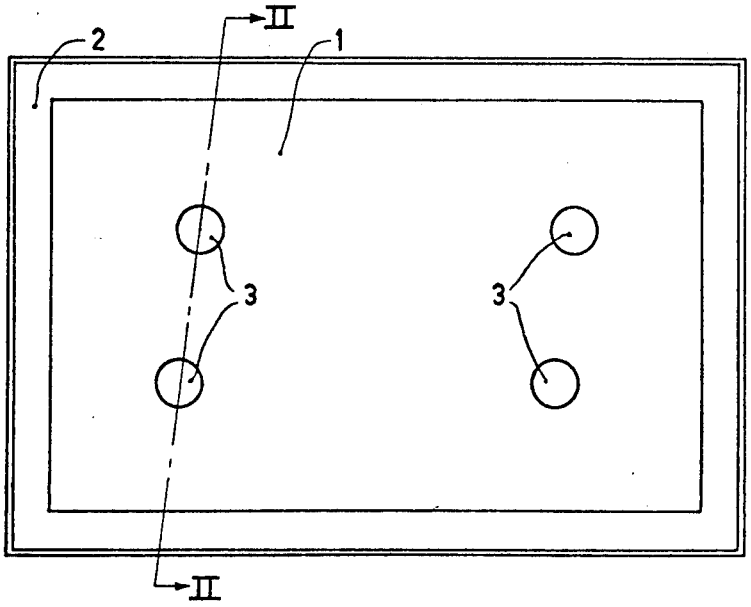
Figure 2:
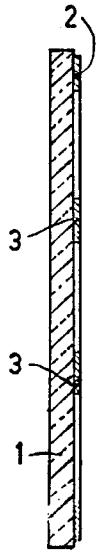

Reference numeral 1 in FIGS. 1 and 2 denotes the glass rear wall of the tube on which a continuous edge 2 of enamel is provided, and the enamel spots 3 at the area of the anodes.

Figure 5:
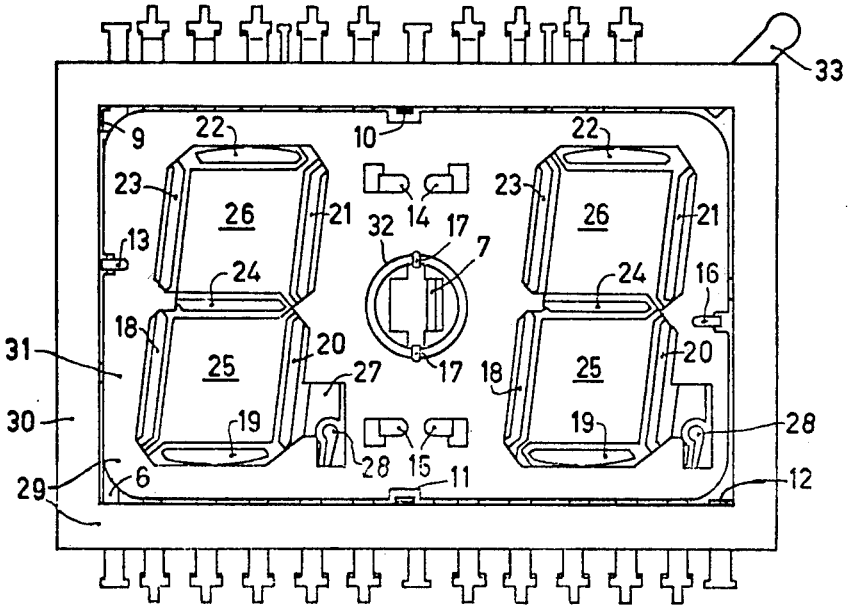
FIG. 5 is a plan view of the tube.
Figure 3:
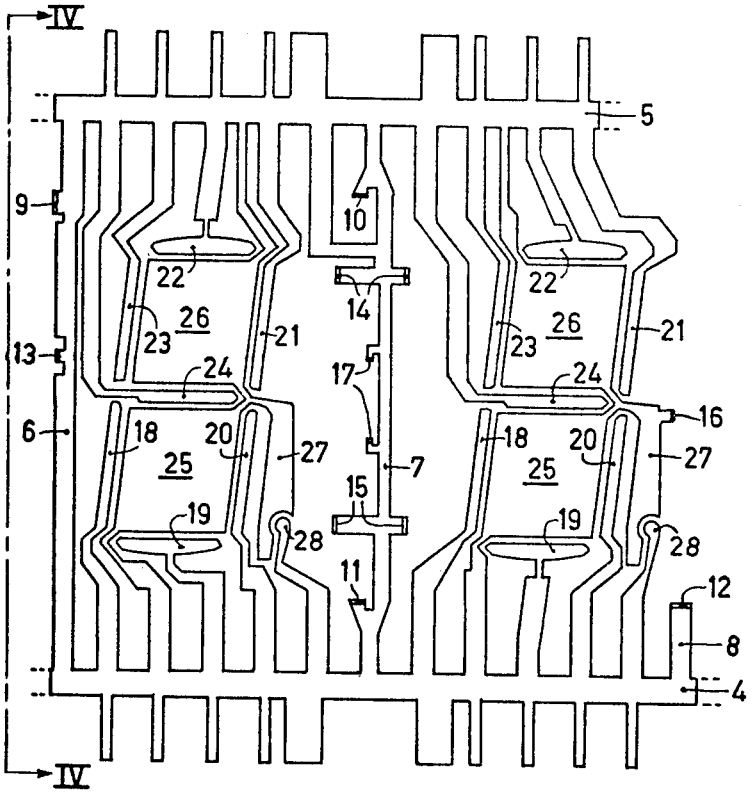
FIG. 3 shows the assembly of electrodes before assembly in the tube.
Figure 4:
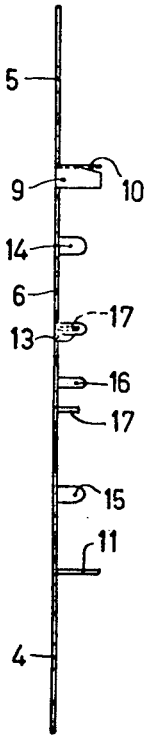
FIG. 4 is a side elevation thereof.

FIG. 3 shows the electrodes as a still cohering etched assembly connected by two metal strips 4 and 5, 6 and 7 are two metal strips connecting the strips 4 and 5. 8 denotes a short strip extending parallel to said strips 6 and 7. Bent parts 9 to 12 of said strips (see FIG. 4) afterwards determine the distance between the front and the rear wall. Bent parts 13 to 15 of these strips and 16 of one of the auxiliary anodes serve to clamp the mica plate. The cathode strips are denoted by 18 to 24, the anodes by 25 and 26, the auxiliary anodes by 27 and the auxiliary cathodes by 28. In FIG. 5 are visible the frame 30 of sintered glass below the front wall 29, the blackened mica plate 31 and the mercury pill 32, also getter. The strips 4 and 5 have been punched away between the supply conductors.

The dimensions of the front and rear wall are 34mm × 22mm. The thickness of each is 1mm and that of the frame of sintered glass is 2 mm. The electrodes are etched from 0.15 mm thick chromium nickel steel and are positioned at 0.05 to 0.1mm from the rear wall. The mica plate is 0.1 mm thick. The gas filling is Ne with 0.5% Ar. The pill contains 1 mg of mercury. The ignition voltage of the discharge was approximately 165 volts. A voltage of 70 volts was applied to the mercury pill. The normal cathode current per segment is 0.35 mA.

What is claimed is:

1. A gas discharge tube for displaying at least two characters, comprising an envelope having flat front and rear glass walls and containing an ionizable medium, a plurality of adjacent matrix groups within said envelope, the matrix elements in at least one group comprising two plate-shaped anodes and elongate cathode strips which are arranged around said two plate-shaped anodes as a stylized 8, an additional anode associated with each of said matrix groups, both the cathode strips and the anodes each forming one assembly, supply conductors secured in a vacuum-tight manner to the glass rear wall by means of enamel, a frame of sintered glass connecting said front and rear walls, a mica plate having openings therein to expose the active front sides of the electrodes, said mica plate being clamped between bent parts of the supply conductors and parts of strips fixed by means of enamel with the supply conductors to the rear wall, the distance between the front wall and the rear wall being determined by parts of said strips bent at right angles to the rear wall, the conductors and parts being fixed by enamel to the rear wall only below the frame of sintered glass and the flat-plate anodes being moreover fixed by enamel to the rear wall over a part of their surface.

2. A gas discharge tube as claimed in claim 1, wherein an annular mercury pill, also getter, is clamped on the mica plate by bent parts of a strip between the matrix groups.

3. A gas discharge tube as claimed in claim 1 wherein an exhaust tube is incorporated in the frame of sintered glass.

* * * * *